United States Patent [19]

Bickford et al.

[11] Patent Number: 5,067,912

[45] Date of Patent: Nov. 26, 1991

[54] SUBASSEMBLY FOR A MICROWAVE CONNECTOR AND METHOD FOR MAKING IT

[75] Inventors: Wayne F. Bickford, East Hampstead, N.H.; Kenneth L. Smith, East Machias, Me.

[73] Assignee: M/A-Com Adams-Russell, Inc., Burlington, Mass.

[21] Appl. No.: 116,473

[22] Filed: Nov. 3, 1987

[51] Int. Cl.[5] ..... H01R 17/18

[52] U.S. Cl. ..... 439/578; 439/736; 29/842

[58] Field of Search ..... 439/578–585, 439/675, 736; 333/254–260, 261, 245; 156/158, 244.11–244.15; 29/868, 856, 858, 841, 848, 883, 885, 631, 842; 264/262, 272.11, 272.12, 272.13, 274, 277

[56] References Cited

U.S. PATENT DOCUMENTS

| | | | |
|---|---|---|---|
| 2,813,922 | 11/1957 | Arnold | 264/262 |
| 2,860,316 | 4/1958 | Watters et al. . | |
| 3,184,706 | 5/1965 | Atkins . | |
| 3,243,321 | 3/1966 | Rowand et al. . | |
| 3,292,117 | 12/1966 | Bryant et al. | 439/578 |
| 3,292,136 | 10/1966 | Somerset . | |
| 3,371,413 | 10/1966 | Rundle . | |
| 3,388,368 | 6/1968 | Sauber | 174/153 |
| 3,522,575 | 8/1970 | Watson et al. | 174/153 R |
| 3,581,269 | 5/1971 | Frey et al. . | |
| 3,634,815 | 1/1971 | Stevens et al. . | |
| 3,697,309 | 10/1972 | Werner et al. . | |
| 3,792,418 | 2/1974 | Kailus . | |
| 4,108,529 | 8/1978 | Evans . | |
| 4,123,401 | 10/1978 | Berghmans et al. . | |
| 4,360,245 | 11/1982 | Nikitas | 439/578 |
| 4,596,435 | 6/1986 | Bickford . | |
| 4,603,023 | 7/1986 | Mack et al. | 264/262 |
| 4,662,703 | 5/1987 | Forney, Jr. et al. | 439/578 |

FOREIGN PATENT DOCUMENTS

| | | | |
|---|---|---|---|
| 2461369 | 3/1981 | France | 333/245 |

*Primary Examiner*—David L. Pirlot

*Attorney, Agent, or Firm*—St. Onge Steward Johnston & Reens

[57] ABSTRACT

A subassembly for microwave structure such as a connector is described. An insulator for spacing of at least one center conductor is formed of PTFE (polytetrafluoroethylene) and effectively bonded to at least one center conductor to be used in the connector. The PTFE may be bonded to the conductor by employing an intermediate layer of FEP (fluorinated ethylene-propylene) that can be bonded to the center conductor. Bonding of the components into an integral subassembly is done in a single step involving heating and pressurizing a pre-assembly in a mold to a sufficient amount and for a sufficient time to provide an acceptably strong bond. Superior electrical characteristics such as a low SWR and insertion loss are achieved in captivated and/or sealed connectors. A good seal is achieved between the insulator and the outer conductor by forming an undercut in the latter, filling it with silicone grease and enabling a temporarily mechanically-collapsed bead on the insulator to expand into the undercut.

11 Claims, 3 Drawing Sheets

SUBASSEMBLY FOR A MICROWAVE CONNECTOR AND METHOD FOR MAKING IT

FIELD OF THE INVENTION

This invention generally relates to a conductor subassembly and a method for making such subassembly. More specifically, this invention relates to sealing a microwave transmission line.

BACKGROUND OF THE INVENTION

In certain applications for microwave transmission line couplings, it is desirable to provide a seal so that coaxial and other microwave components can be suitably isolated from ambient environments which include air, water, pressure changes and chemicals. It is also important that the center conductor in coaxial couplings be firmly held in position despite axial stresses that may be encountered due to temperature variations, mechanical stresses, or during installation of coaxial cables connected to the couplings. The center conductor is held in place with dielectric elements that seat against axial surfaces on both the center and outer conductors, see for example U.S. Pat. No. 4,596.435.

Various dielectric materials have been proposed for use in coaxial couplings including polytetrafluoroethlene (PTFE) sold under the trademark TEFLON (by the DuPont Company). PTFE, which is an excellent dielectric material for use in coaxial couplings, however, does not always form a satisfactory seal. PTFE has been used to coat metal surfaces for cooking utensils, see for example, U.S. Pat. Nos. 3,243,321; 3,697,309 and 4,123,401. These processes involve the application of a PTFE dispersion to a prepared metal surface which is then baked at an elevated temperature. Although these techniques provide a thin PTFE surface that adheres to metal, it is not satisfactory for a microwave transmission line coupling. For example, a relatively thick PTFE insulator is required between the central and outer conductors of a coaxial connector.

SUMMARY OF THE INVENTION

In a microwave transmission line coupling in accordance with the invention, a PTFE dielectric is effectively firmly bonded to a conductor to form a subassembly in which an excellent seal with the conductor is obtained with an adherence capable of withstanding strong axial shear forces. The electromagnetic transmission line characteristics can be established by selection of the dielectric and conductor materials and suitably shaping the dielectric and conductor.

This is achieved with one technique in accordance with the invention by forming a preassembly of a metal conductor, an inner insulator layer adjacent the conductor and formed of one type of fluoroplastic material which can be bonded to the conductor and a second insulator layer of another fluoroplastic material that can be bonded to the inner insulation layer. The components in the preassembly are then bonded together by the application of heat and pressure to form a subassembly. This is then shaped, if necessary, to fit as a conductor subassembly in the microwave transmission line coupling.

With a technique in accordance with the invention the preferred electromagnetic characteristics of a PTFE dielectric can be utilized in a microwave coaxial connector while achieving satisfactory physical performance. For example, in one microwave coaxial connector, a subassembly in accordance with the invention is used for a central conductor and a dielectric. This involves forming a preassembly that includes a berylium copper center conductor, an inner sleeve formed of fluorinated ethylene-propylene, also known as FEP, and an outer insulator layer of PTFE. The individual components are first thoroughly cleaned and preassembled inside a bonding apparatus with the PTFE and FEP insulators.

Heat and pressure are then applied in sufficient amounts and for a sufficient time to bond the FEP inner sleeve to the central conductor and the sleeve to the outer PTFE layer to form an integral subassembly in which the PTFE dielectric is in effect bonded to the conductor. The subassembly is then machined into a shape suitable for use in the microwave connector.

With a microwave subassembly in accordance with the invention, the dielectric adhesion to a center conductor is improved to achieve a better heat transfer from the center conductor to the outer conductor while also maintaining an improved dimensional stability during temperature variations. O-rings, that are often used for sealing can be eliminated, thereby decreasing insertion losses in a microwave connector and enabling higher power handling, decreasing the reflection of energy and improving the transmission phase characteristics.

In another feature of the invention, an insulator subassembly is formed of bonded layers of different fluoroplastic materials. One layer is formed of FEP and another of PTFE. These materials are joined by the application of heat and pressure. The insulator subassembly may be directly used in a microwave structure or used therein after machining into a desired shape.

It is, therefore, an object of the invention to provide a PTFE/conductor subassembly for use in connectors, multiconductor structures, waveguide joints, antennas and other devices having a need for plastic to metal seals and a method for making same. It is a further object of the invention to provide an insulator subassembly for use in microwave structures.

These and other objects of the invention can be understood from the following description of one illustrative embodiment that is described with reference to the following drawings.

DETAILED DESCRIPTION OF DRAWINGS

Figure 1:
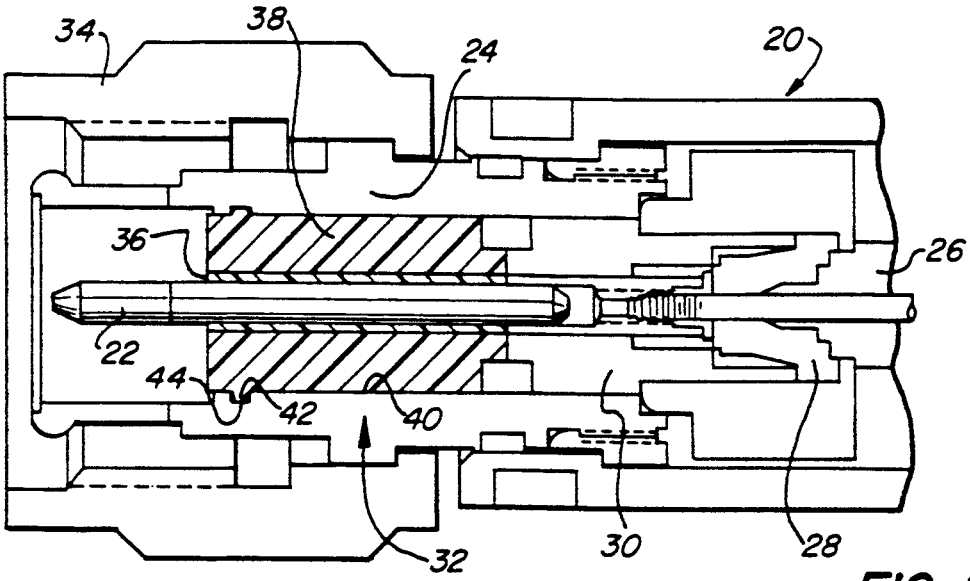
FIG. 1 is a section view of one microwave coaxial connector using a PTFE/conductor subassembly in accordance with the invention.

With reference to FIG. 1, a male coaxial connector 20 is shown formed with a center conductor 22 and outer cylindrical conductor 24. The inner and outer conductors 22, 24 are connected to a coaxial cable 26 having a nominal characteristic impedance. The sizing of the outer conductor and shapes of appropriate insulator spacers such as the captivating bead 28 and insulator 30 as well as a subassembly 32 are selected to match the characteristic impedance and thus minimize any SWR (standing wave ratio). FIG. 1 shows a TNC male coaxial connector though of course the invention can be used with female connectors, adapters, microwave structures including waveguide joints and antennas, and such other devices in which either a conductor is to be bonded to a PTFE insulator or an insulator formed of one type of fluoroplastic is to be bonded to a different fluoroplastic material.

The male connector 20 includes an internally threaded knurled outer coupling nut 34 and appropriate other components as are well known in the art. The SWR and power handling capability for the connectors are sensitive to dimensional changes that may occur with temperature variations.

It is desired to provide an insulator spacer for the center conductor 22 with stable dimensions when subjected to mechanical stresses, yet with good electrical characteristics, low insertion loss and while retaining a good seal when this is desired such as for use with CW coaxial cable systems. Insulators that are made of PTFE have such characteristic but do not seal to a metal conductor without the use of O-rings o other devices.

In the subassembly 32, however, an insulator is employed which is formed of an inner sleeve 36 of a fluoroplastic material that can bond to the metal center conductor 22 and an outer insulator or spacer 38 of PTFE that in turn bonds to the inner sleeve 36.

The inner sleeve is preferably made of a fluoroplastic such as fluorinated ethylene-propylene. Such sleeve can be formed by an extrusion process using heated pellets of commercially available FEP. The sleeve thickness preferably is kept thin, of the order of about less than 0.010 inches, sufficient to form a bond with center conductor 22 and minimize any negative impact on electromagnetic characteristics such as SWR and insertion loss.

The outer cylindrically-shaped insulator 38 is formed of PTFE and is shaped to snugly fit within the internal bore 40 of outer conductor 24. A circular bead 42 is formed on the outer insulator 88 to fit inside a complementary slot 44 in the wall of bore 40. PTFE lends itself well to machining into such a shape as well as a subsequent appropriate temporary deformation required to collapse the bead 42 to enable subassembly 32 to be inserted into bore 40.

Figure 2A:
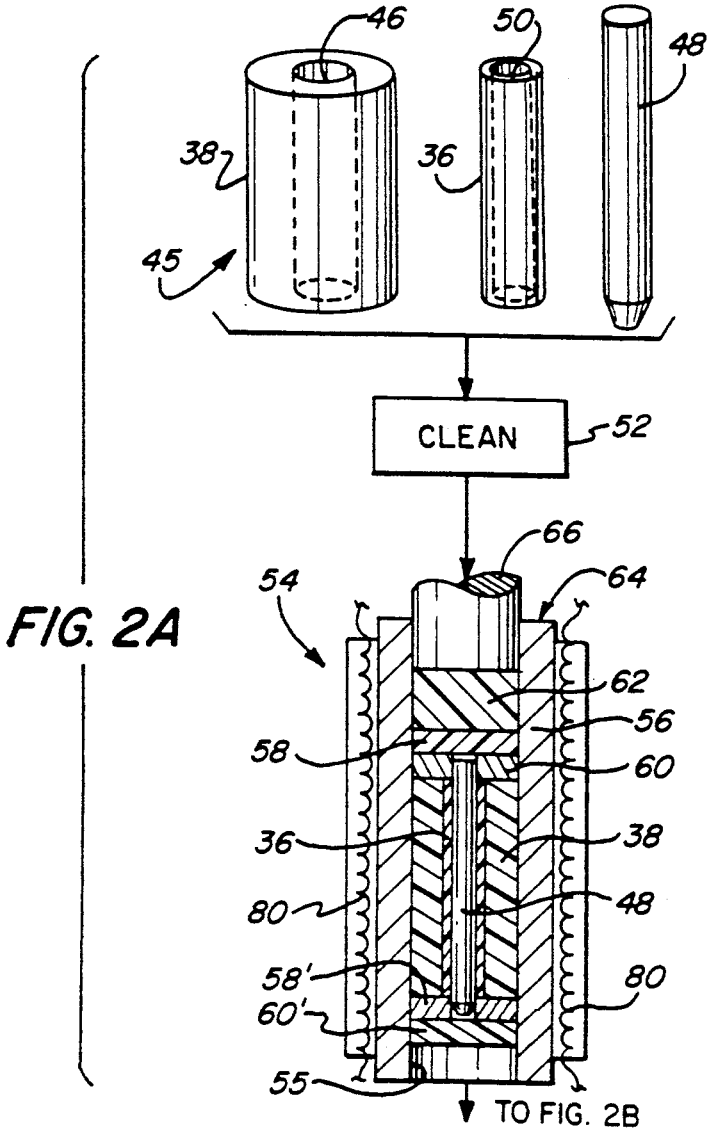
FIGS. 2A and 2B are schematic representations of steps used in the method of making a PTFE/conductor subassembly in accordance with the invention.
Figure 2B:
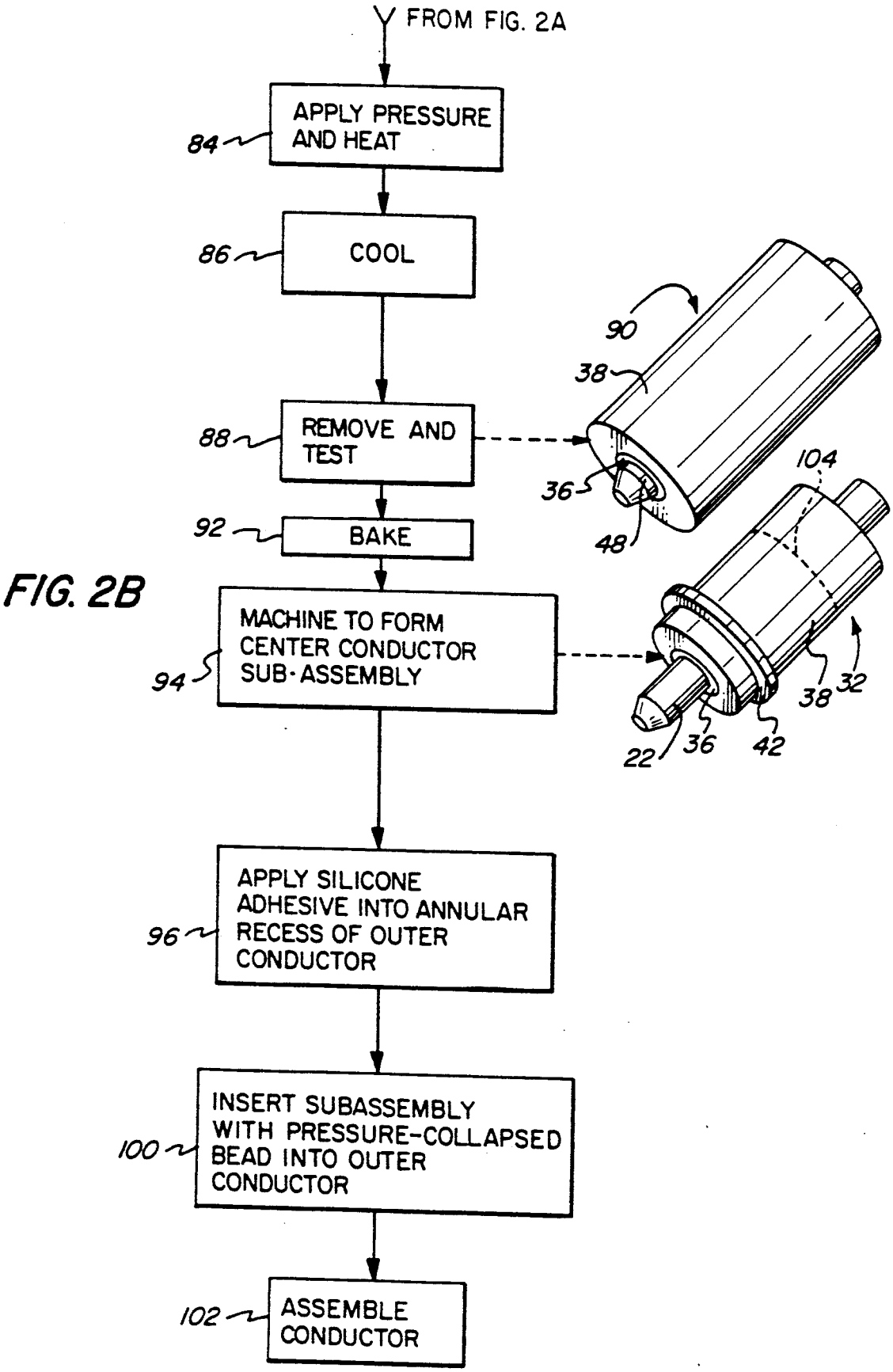

FIGS. 2A and 2B illustrate the steps involved in making subassembly 32. At 45 components are formed and preassembled. These components are a cylindrical outer insulator 38 made of PTFE and which is provided with a through-bore 46. An inner sleeve 36 of FEP is cut to the same length as PTFE insulator 38 and has an external diameter that enables a snug fit in bore 46 of insulator 38. A center conductor 48 made preferably of beryllium copper is provided. Bore 50 of inner sleeve 36 is sized to snugly fit around the center conductor.

At 52 all parts shown at 45 are prepared and cleaned. The fluoroplastic parts are cleaned in an ultrasonic cleaner filled with liquid freon for about five minutes. The parts are then removed, without skin contact, and allowed to air dry on a suitable surface. Rubber gloves should be used to manually handle any part.

The plastic components are then preassembled by placing the FEP sleeve inside bore 46 and, if necessary, cutting away any excess length of sleeve 36. Once the fit has been established, preferably a recleaning of the plastic by soaking in liquid freon for five minutes is done.

The center conductor 48 is cleaned by placing it, using gold-plated tweezers, into a brite dip acid for a brief time of about five seconds. The foam caused by the acid is then rinsed away in clean water and the conductor is then cleaned in liquid freon and allowed to dry.

All the components are then at 54 preassembled in a cavity 55 of a mold 56, that is temporarily placed on its side, with the ends of FEP sleeve 36 flush with the ends of PTFE insulator 38. The copper center conductor 48 is placed in bore 50 with small protrusions from each end as shown. Small metal discs 58, 58′ with central holes are placed over the protruding ends of center conductor 48. PTFE disc-shaped slugs 60, 60′ are then placed over metal discs 58, 58′. A metal plug 62 is placed over disc 60.

Figure 3:
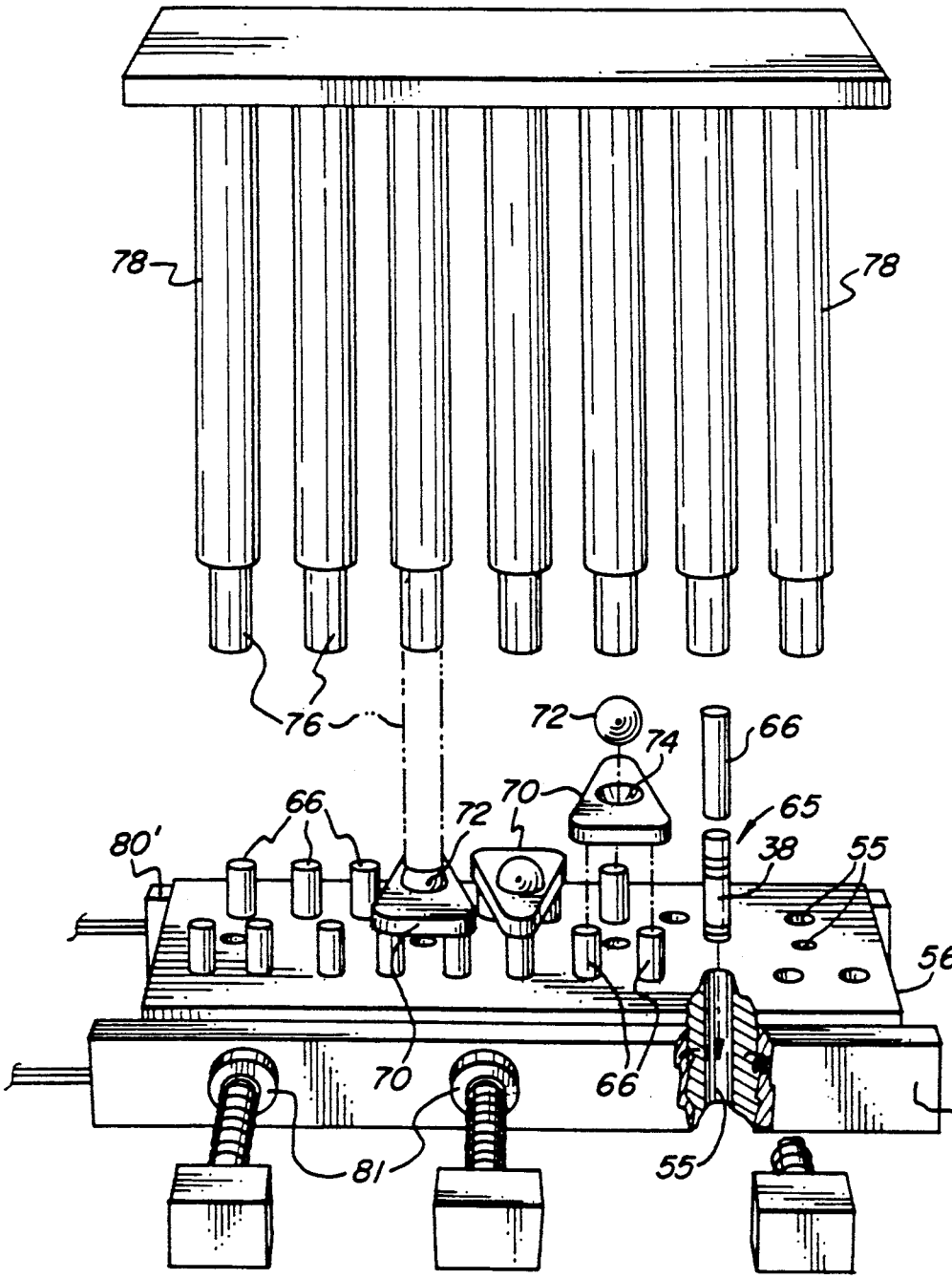
FIG. 3 is a perspective view of one apparatus used to make the PTFE apparatus used to make the PTFE/-conductor subassembly show in FIG. 1.

This same procedure is followed for each of similar mold cavities 55 in the apparatus shown in FIG. 3. When the desired mold cavities 55 are filled, the mold 56 is placed with the right side 64 up, using an appropriate material to prevent the cavity inserted components from falling out of the bottom. Mold 56 is then placed on a suitable pressure plate, not shown, so that the preassemblies 65 in the mold cavities 55 can be placed under pressure with heat.

Metal plungers 66, see FIG. 3, are then placed in the cavities 55. The tops of the plungers are covered by triangular pressure plates 70, each sized to contact three plungers 66. A steel ball 72 is placed in an appropriate spherically-shaped recess 74 on each plate 70 for contact by a piston 76 from a hydraulic actuator 78.

Heaters such as 80, 80′ are applied to the side of the steel mold 56 and are held in place with spring biased heat insulator elements 81. Pistons 76 are applied to balls 72 while assuring the alignment of the plates 70 with plungers 66.

With the pistons 76 brought first into light contact with balls, heat is applied to mold 56 by heaters 80, 80′. The mold temperature is brought up to about 750° F. During this heating the mold parts tend to expand and some pressure may register on the gauge (not shown) used to monitor hydraulic actuators 78. This temperature may vary for different fluoroplastic materials, but when FEP and PTFE are used preferably are in the range from about 730° F. to about 750° F.

The mold 56 remains at an elevated temperature of above about 750° F. for ten minutes before significant hydraulic pressure is applied by an actuator 78. The pressure is then increased at 84 in FIG. 2B to about 2000 lbs. for each actuator 78 or 667 lbs. per plunger 66. This corresponds to a pressure of about 13,588 lbs. per square inch for each cavity 55, with cylindrical cavity and plunger diameters of a quarter of an inch. This compressive force may vary but it has been found that a range of plus about 20 percent to minus about 10 percent of these values is desired for the described materials, i.e., a range generally extending from about 10,500 psi to about 16,500 psi. Pressure should therefore be constantly monitored and adjusted to remain within this range. After about 15 minutes of such pressure and heat, the heat is removed and the mold 56 with cavity inserts permitted to cool at step 86 while remaining pressurized until the mold temperature drops to below 100° F. Fans can be used to accelerate the cooling.

After cooling, the preassemblies 65 with associated discs 58, 58′, 60, 60′ are removed from the cavities 55 at step 88 in FIG. 2B. An arbor press may be required to do so. The removal of the discs exposes the ends of center conductor 48 and a preliminary pressure test is made to assure that good adhesion between the conductor 48 and fluoroplastic layer 36 and between layers 36 and 38 was obtained to form an integral subassembly 90. This involves applying an appropriate push test to conductor 48. The push test is done with a force that depends upon the size of the subassembly, with a desired higher force of about 75 lbs. for large preassemblies and a smaller force of about 50 lbs. for smaller subassemblies.

The subassemblies 90 that pass the pressure test are then baked at 92 in an oven set at about 400° F. ±10° F. for a period of about 12 hours after which the subassemblies 90 are allowed to cool.

At 94 a final shaping of the subassemblies 90 is done by a machining process that produces the bead 42. This results in a final subassembly 32 as also shown in FIG. 1 and which is ready for installation into a connector such as 20.

At 96 the annular slot 44 inside the wall of inner bore 40 of outer conductor 24 (see FIG. 1) is lined with a silicone adhesive or silicone grease. The subassembly 90 is then forced at 100 into a die in which the PTFE bead 42 is collapsed and the preassembly is moved into bore 40 until annular bead 42 is opposite annular slot 44 into which bead 42 expands while the adhesive provides additional sealing and engagement between the outer conductor 24 and PTFE insulator 38. Completion of the assembly of connector 20 is done at 102.

With a PTFE subassembly, 32 formed in accordance with the invention a very low VSWR can be achieved and maintained throughout a wide range of temperature and axial force conditions.

Variations of the described technique can be adopted. For example, the subassembly 32 can be formed entirely of FEP. However, in such case the subassembly form such as 90 still needs to be machined and FEP does not lend itself well to machining. The subassembly can be formed of two different front and back parts of PTFE and FEP respectively so as to still take advantage of the easier adherence of the FEP to the central conductor. Such subassembly is suggested by dotted line 104 in FIG. 2B where the front part would be made of PTFE and include bead 42. The subassembly can be without the conductor with solid fluoroplastic parts. The improved seal obtained between the subassembly and the undercut 44 in the outer conductor can also be achieved with an inner conductor that has an undercut. Sufficient silicone grease should be used in the undercut so as to assure a good seal between the expanding bead and the wall of the undercut.

Having thus described an illustrative form of the invention variations can be made without departing from the scope of the invention.

What is claimed is:

1. A method for making a conductor subassembly comprising the steps of:

forming a preassembly of a metal conductor placed adjacent a first layer of a first fluoroplastic material and with the first layer placed adjacent a second layer formed of a second fluoroplastic material; said first fluoroplastic material being more readily bondable to said conductor than the second fluoroplastic material and being bondable to said second fluoroplastic material; and applying heat and pressure to the preassembled conductor, and the first and second layer in a sufficient amount and for a sufficient time to bond the conductor to the first layer and the first layer to the second layer to form an integral subassembly.

2. The method as claimed in claim 1 and further comprising the step of:

thoroughly cleaning the metal conductor and said first and second layers of fluoroplastic materials.

3. The method as claimed in claim 1 and further including the steps of:

forming a central conductor, a sleeve of said first fluoroplastic material and shaped to snugly surround the central conductor and a cylindrical insulator formed of said second fluoroplastic material and having a through bore sized to snugly fit around said sleeve.

4. The method as claimed in claim 1 wherein the first fluoroplastic material is fluorinated ethylene-propylene and said second fluoroplastic material is polytetrafluoroethylene.

5. The method as claimed in claim 4 wherein the heat and pressure applying steps comprise respectively applying heat in an amount so as to establish a temperature in the range from about 730° F. to about 750° F.; and applying pressure at a level in the range from about 10,500 psi to about 16,500 psi.

6. The method as claimed in claim 5 wherein the assembling step includes the steps of:

first heating the preassembly to said desired temperature and then applying said pressure while maintaining the temperature.

7. A microwave structure comprising an integral subassembly formed of a center conductor for a coaxial connector, a first insulative sleeve layer formed of an FEP fluoroplastic material with said sleeve bonded to the conductor and a second cylindrical insulative layer of a second PTFE fluoroplastic material having a through bore sized to snugly enclose the sleeve and being sized to form an insulator spacer for the center conductor in the coaxial connector;

wherein the coaxial connector has a cylindrical outer conductor having a bore sized to snugly receive the second insulative layer and having an inwardly-facing annular recess, said second insulative layer being provided with a collapsible externally projecting annular bead sized to fit inside the recess and engage walls thereof.

8. A microwave structure comprising an integral subassembly formed of a center conductor for a coaxial connector, a first insulative sleeve layer formed of a FEP fluoroplastic material with said sleeve bonded to the conductor and a second cylindrical insulative layer of a second PTFE fluoroplastic material having a through bore sized to snugly enclose the sleeve and being sized to form an insulator spacer for the center conductor in the coaxial connector;

wherein the first fluoroplastic insulative layer surrounds the conductor and is bonded thereto at one side of the conductor and wherein the second fluoroplastic material insulative layer surrounds the conductor at another side of the conductor and is bonded to a side of the first fluoroplastic material.

9. In a microwave structure having a conductor, the improvement comprising:

an annular undercut formed in the conductor;

an insulator formed of PTFE and having an annular bead sized to expand into the undercut after mechanical collapse to fit the insulator to the conductor; and a silicone material placed inside the undercut to form a seal between the insulator and said conductor.

10. The microwave coaxial structure as claimed in claim 8 wherein the silicone material is silicone grease.

11. The microwave coaxial structure as claimed in claim 10 wherein said conductor is an outer conductor of a microwave coaxial connector.

* * * * *